US007628315B2

(12) United States Patent
Duncan

(10) Patent No.: US 7,628,315 B2
(45) Date of Patent: Dec. 8, 2009

(54) SCORE COUNTER

(76) Inventor: Allen Gary Duncan, 7526 Little River Dam Rd., Radford, VA (US) 24141

( * ) Notice: Subject to any disclaimer, the term of this patent is extended or adjusted under 35 U.S.C. 154(b) by 347 days.

(21) Appl. No.: 11/604,111

(22) Filed: Nov. 24, 2006

(65) Prior Publication Data

US 2008/0121683 A1 May 29, 2008

(51) Int. Cl.
*A63B 71/06* (2006.01)

(52) U.S. Cl. ..... 235/127; 235/1 B; 235/78 G; 116/315; 116/223

(58) Field of Classification Search ..... 968/145; 235/1 B, 127, 103, 104, 77, 78 A, 78 F, 78 G, 235/78 R, 78 M, 88 G, 88 R, 116, 117 A, 235/119, 121; 473/131; 2/161.2; 116/222–224, 116/308, 309, 311–313, 315, 318
See application file for complete search history.

(56) References Cited

U.S. PATENT DOCUMENTS 1,454,263 A * 5/1923 Beskow ..... 235/116
1,460,842 A * 7/1923 Brooks ..... 235/121
1,470,904 A * 10/1923 Beskow ..... 235/113
1,497,111 A * 6/1924 Mason ..... 346/14 R
1,568,640 A * 1/1926 Sweeney ..... 235/91 R
2,485,191 A * 10/1949 Culver ..... 235/83
4,922,850 A * 5/1990 Conley ..... 116/222
5,340,105 A * 8/1994 Gostyla ..... 273/142 R
5,419,551 A * 5/1995 Hoyt et al. ..... 473/408
5,550,884 A * 8/1996 Berney ..... 377/5
5,730,658 A * 3/1998 Kurtz et al. ..... 473/205
5,769,740 A * 6/1998 Colangelo ..... 473/408
6,456,568 B1 * 9/2002 Geiger ..... 368/10
6,543,681 B1 * 4/2003 Wiederrecht et al. ..... 235/60 C
6,646,958 B1 * 11/2003 Geiger ..... 368/10
7,057,976 B2 * 6/2006 Berseth et al. ..... 368/10
7,457,201 B2 * 11/2008 Jaermann et al. ..... 368/10
2009/0025625 A1 * 1/2009 Lee ..... 116/223

* cited by examiner

*Primary Examiner*—Michael G Lee
*Assistant Examiner*—Suezu Ellis

(57) ABSTRACT

This invention counts golf strokes per hole. It is worn on a golfer's wrist, on a lanyard, placed in a pocket, or clipped on one's clothing. It allows a full range of non-restrictive movement and is indexed between twelve positions patterned after the hours of a clock. The starting position is at 12 o'clock, first shot is 1 o'clock, second shot is 2 o'clock, etc. This enables the user to simply click to the subsequent position without the need to read the display. The pointer is mounted to a base and rotates, having 12 equally spaced positions. Each position is secured in place by means of a ball or radius shaft that is spring-loaded into one of the 12 equally spaced indentations in the base. The ball requires little or no friction during indexing but provides sufficient holding pressure, ensuring that the indicator is held firmly into position.

3 Claims, 1 Drawing Sheet

SCORE COUNTER

FIELD OF THE INVENTION

The present invention relates to score keeper for events and, more particularly, to keeping the strokes per hole during a golf game.

BACKGROUND ART

Golfing requires much concentration and the need to accurately remember the number of strokes taken to put the ball in each hole. Remembering the number of strokes per hole can create stress and negatively affect one's game.

Recording devices currently available require good vision and skill to operate. Thus if a golfer requires wearing reading glasses, extra care is taken to keep up with the glasses. In addition extra thought must be given to ensure the correct process is taken (or the right button is pushed) to keep the score accurate.

Inaccurate score keeping in a round of golf is considered unprofessional and can lead to hostile situations during the game.

In U.S. Pat. No. 4,922,850 issue to Conley, U.S. Pat. No. 3,847,110 issued to Inoue, and U.S. Pat. No. 4,557,215 issued to Petersson, golf score counters are described. However all of these frictionally engage the score position and do not snap into the score position.

In U.S. Pat. No. 6,401,254 issued to Boller and U.S. Pat. No. 4,367,526 issued to McGeary, golf score counters are described. However, they require a battery or solar cell to operate.

In U.S. Pat. No. 1,460,842 issued to Brooks, a golf stroke counter is described. However the lock-into position piece scrapes over the base during indexing, creating undesirable friction.

OBJECTS AND ADVANTAGES

Accordingly, it is a primary object of the present invention to provide an accurate method for a golfer to keep track of the number of shots taken to put the ball in the hole, patterned after the hour positions of an analog clock.

It is a further object of the invention to provide a score keeper that can be used to easily determine the score or enter a stroke with minimum or no vision required.

It is a further object of the invention to provide a score keeper that can be worn on the arm as a watch, on a lanyard, kept in a pocket, or clipped on a golfer's belt.

It is a further object of the invention to provide a score keeper that requires no electrical source of energy.

SUMMARY OF THE INVENTION

These objects and advantages are attained by providing a score keeper patterned after the positions on an analog clock. The indexing positions correspond to the positions of a 12 hour analog clock face, providing the user quickly recognizable access to the score attained. The user operates the device by turning the rotating dial to the next clockwise position, where it clicks into place. At the conclusion of each hole, the user records the score and easily resets the dial by moving it back to starting "0" (12 o'clock) position.

As shown in the drawings, the golf stroke counter of the invention comprises a base member having a plurality of spaced apart circumferentially arrayed detents on an upper surface thereof, and an indicator member rotatably mounted to said base member in overlying relationship to the base member upper surface. The indicator member has detent means on a bottom surface positioned to cooperate with the detents on the upper surface of the base member, and the indicator member is manually rotatable to move the detent means on its bottom surface from registry with one of the detents on the base member to registry with an adjacent detent on the base member, each movement of the detent means on the indicator member from one detent on the base member to a successive adjoining detent on the base member indicating that one stroke has been taken. The detents on the upper surface of the base member each comprise an indentation in the upper surface, and the detent means on the bottom surface of the indicator member comprises a resiliently yieldable protrusion engageable in the indentations. There are twelve indentations, corresponding generally to the arrangement and positions of hour marks on an analog clock, and there are two diametrically opposed protrusions on the indicator member, said protrusions being engageable in respective diametrically opposed indentations in the base member. The protrusions each comprise a ball biased outwardly of the bottom surface of the indicator member by a spring engaged between the indicator member and the ball. In a preferred the base member comprises a generally circular-shaped disc member, and the indicator member comprises a generally circular-shaped member of smaller diameter than the base member. The indicator member has a centrally located shaft on its bottom surface, rotatably received in a central bore in the base member and fixed against withdrawal from the bore so that the indicator member is held assembled to the base member.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the FIGURES.

DETAILED DESCRIPTION OF THE PREFERRED EMBODIMENT

Although the following detailed description contains many specifics for the purpose of illustration, anyone with ordinary skill in the art will appreciate that many variations and alterations to the following details are within the scope of the invention. Accordingly, the following preferred embodiment of the invention is set forth without any loss of generality to, and without imposing limitations upon, the claimed invention.

Figure 1A:
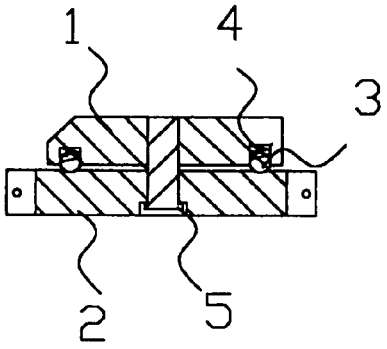
FIG. 1A is a cross-sectional assembly view of a Score Keeper preferred design.
Figure 1B:
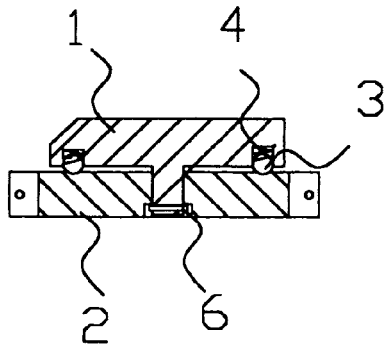
FIG. 1B is a cross-sectional view assembly of a Score Keeper optional design.
Figure 2A:
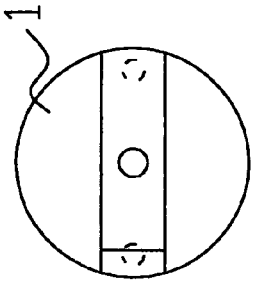
FIG. 2A is the top view of the Score Keeper indicator member.
Figure 2B:
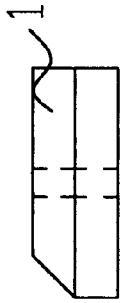
FIG. 2B is the front view of the Score Keeper indicator member.
Figure 2C:
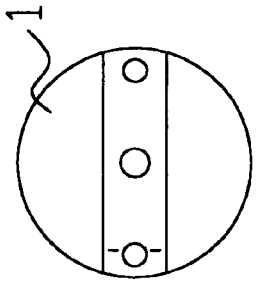
FIG. 2C is the bottom view of the Score Keeper indicator member.
Figure 3:
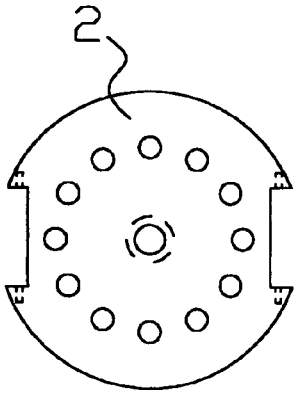
FIG. 3 is the top view of the base member.
Figure 4:
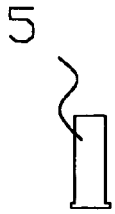
FIG. 4 is a side view of the shaft member.

A preferred embodiment of the invention is shown in FIG. 1A. An indicator 1 can rotate around base 2, stopping at one of twelve positions. FIG. 3 shows the base 2 with twelve indentations. These indentations allow the ball 3 or balls to enter and act as a position holder. A coil spring 4 or springs provide tension to the ball 3, thus creating holding position. Shaft 5, shown in FIG. 1A, is bonded or pressed into indicator 1. Alternatively, a retaining ring 6, shown in FIG. 1B, may be used to keep the indicator 1 and base 2 together.

In the preferred embodiment, the user would start the score keeper at the twelve o'clock position. After each stroke during an event, the indicator 1 would be rotated one clockwise index.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A golf stroke counter, comprising:

a generally flat, disc-shaped, circular base member having a diameter and twelve equally spaced circumferentially arrayed indentations in an upper surface thereof forming detents in said upper surface that correspond generally to the number and positions of hour marks on an analog clock;

an elongate, generally rectangularly shaped indicator member rotatably mounted to said base member in overlying relationship to said base member upper surface, said indicator member having at least one detent ball resiliently yieldably biased outwardly of the bottom surface thereof by a spring engaged between the indicator member and said at least one detent ball, after each stroke is taken said indicator member being manually rotated to move said at least one detent ball on its bottom surface from registry with one of the indentations in the base member upper surface to registry with an adjacent indentation in the base member upper surface, each movement of said at least one detent ball on the indicator member from one indentation on the base member to a successive adjoining indentation on the base member indicating that one stroke has been taken, wherein engagement of said at least one detent ball in a respective indentation provides a tactile feel that the indicator member has been moved from one position to a next adjoining position without having to visually observe the golf stroke counter, and the correspondence of the indentation positions to the positioning and number of hour marks on an analog clock enable the user to quickly and easily determine the number of strokes that have been taken with only a quick glance at the golf stroke counter.

2. A golf stroke counter as claimed in claim 1, wherein:

there are two diametrically opposed said detent balls on said indicator member, said detent balls being engageable in respective diametrically opposed indentations in said base member.

3. A golf stroke counter as claimed in claim 1, wherein:

said indicator member has a length that is smaller than the diameter of said base member; and said indicator member has a centrally located shaft projecting from its bottom surface, said shaft rotatably received in a central bore in said base member and fixed against withdrawal from said bore so that said indicator member is held assembled to said base member.

* * * * *